US005165789A

United States Patent [19]

Womack

[11] Patent Number: 5,165,789

[45] Date of Patent: Nov. 24, 1992

[54] LIMITED ACCESS LONG STEMMED SMALL DIAMETER PROBE LIGHT

[76] Inventor: Robert c. Womack, 5119 Radbrook Pl., Dallas, Tex. 75220

[21] Appl. No.: 731,198

[22] Filed: Jul. 15, 1991

[51] Int. Cl.[5] ..... F21V 21/16

[52] U.S. Cl. ..... 362/391; 362/255; 362/256; 362/377; 362/378; 362/437

[58] Field of Search ..... 362/186, 376, 377, 387, 362/391, 437, 378, 439, 255, 256

[56] References Cited

U.S. PATENT DOCUMENTS

| | | | |
|---|---|---|---|
| 573,322 | 1/1987 | Benjamin | 362/437 |
| 2,225,391 | 12/1940 | Pierce | 362/378 |
| 3,584,213 | 6/1971 | Meltzer | 362/378 |
| 3,862,410 | 1/1975 | Maxwell | 362/186 |
| 4,509,104 | 4/1985 | Suzuki et al. | 362/294 |
| 4,998,190 | 3/1991 | Claessen | 362/391 |
| 5,099,404 | 3/1992 | Kenum | 362/376 |

FOREIGN PATENT DOCUMENTS

| | | | |
|---|---|---|---|
| 60444 | 12/1891 | Fed. Rep. of Germany | 362/376 |
| 112883 | 8/1900 | Fed. Rep. of Germany | 362/376 |
| 181004 | 12/1906 | Fed. Rep. of Germany | 362/376 |
| 237942 | 12/1909 | Fed. Rep. of Germany | 362/387 |
| 520435 | 4/1940 | United Kingdom | 362/391 |

*Primary Examiner*—Ira S. Lazarus
*Assistant Examiner*—Y. Quach
*Attorney, Agent, or Firm*—Warren H. Kintzinger

[57] ABSTRACT

A probe light is provided with two power lines passed through a long tubular small diameter brass rod extended from a handle with a plug in socket connection to a power supply to a small cross sectional halogen lamp bulb socket for a small diameter halogen light bulb. The halogen light bulb used is a high intensity light bulb pulling relatively high amperage developing considerable heat. The tubular small diameter brass rod, that is bendable for use convenience, conducts heat away from the lamp bulb socket and the plug in leads of the lamp bulb are bent in a wave shape to insure good electrical contact through an extensive heat temperature range. The lamp bulb leads plug into internal openings in the two socket pins held within the lamp bulb socket with the socket pins being heavy duty pins also conducting heat away from the lamp bulb leads. A high temperature teflon sheath heat shrunk on the lamp bulb not only gives protection from high pressure shattering of the bulb but also diffuses the light to a more uniform illuminating source.

19 Claims, 2 Drawing Sheets

LIMITED ACCESS LONG STEMMED SMALL DIAMETER PROBE LIGHT

Figures 1, 2, 3, 4, 5:
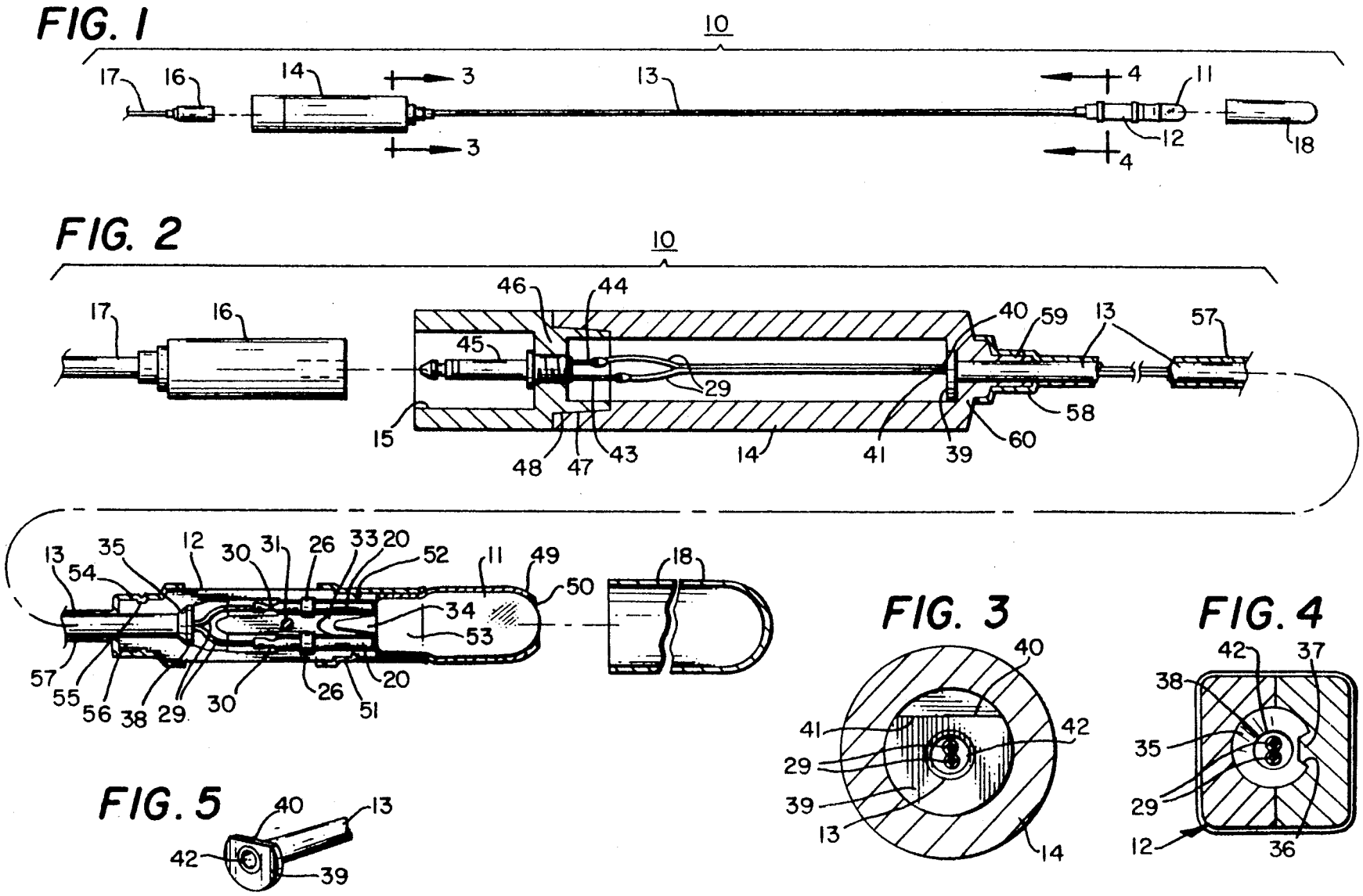

This invention relates in general to close quarter internal lighting, and more particularly, to a bright high intensity small diameter long stemmed light for good lighting in closely confined spaces.

Lighting in closely confined quarters such as within the interior of a vehicle door where work must be done or within a turbine engine where turbine blades are being inspected requires adequately strong lighting. Many lighting systems herebefore have been too weak, too large and awkward in use and/or too expensive. Dispensing heat with such internal lighting systems is also a consideration to be addressed. Light glare back to a user's eyes should be minimized with a high intensity light for more effective lighted viewing of internal components in a confined space.

It is therefore a principal object of this invention to provide strong effective lighting for the interior of closely confined enclosed work spaces.

Another object is to provide a probe light with a small diameter high intensity light bulb mounted on a long tubular small diameter bendable metal rod extended from an external handle.

A further object is to effectively conduct heat away from a high intensity high heat generating probe light bulb.

Still another object is to provide protection from high pressure shattering of a light probe bulb.

Features of the invention useful in accomplishing the above objects include, in a limited access along tubular stem mounted small diameter probe light, a long tubular small diameter brass rod mounted small diameter high intensity high heat generating proble light bulb with two power lines passed through the tubular rod extended from a handle with a plug in socket connection to a power supply. The probe includes a small cross sectional halogen lamp bulb socket for a small diameter halogen light bulb. The halogen light bulb used is a high intensity light bulb pulling relatively high amperage developing considerable heat. The tubular small diameter brass rod, that is bendable for use convenience, conducts heat away from the lamp bulb socket and the plug in leads of the lamp bulb are bent in a wave shape to insure good electrical contact through an extensive heat temperature range. The lamp bulb leads plug into internal openings in the two socket pins held within the lamp bulb socket with the socket pins being heavy duty pins also conducting heat away from the lamp bulb leads. A high temperature teflon sheath heat shrunk on the lamp bulb not only gives protection from high pressure shattering of the bulb but also diffuses the light to a more uniform illuminating source.

A specific embodiment representing what is presently regarded as the best mode of carrying out the invention is illustrated in the accompanying drawings.

Figure 6:
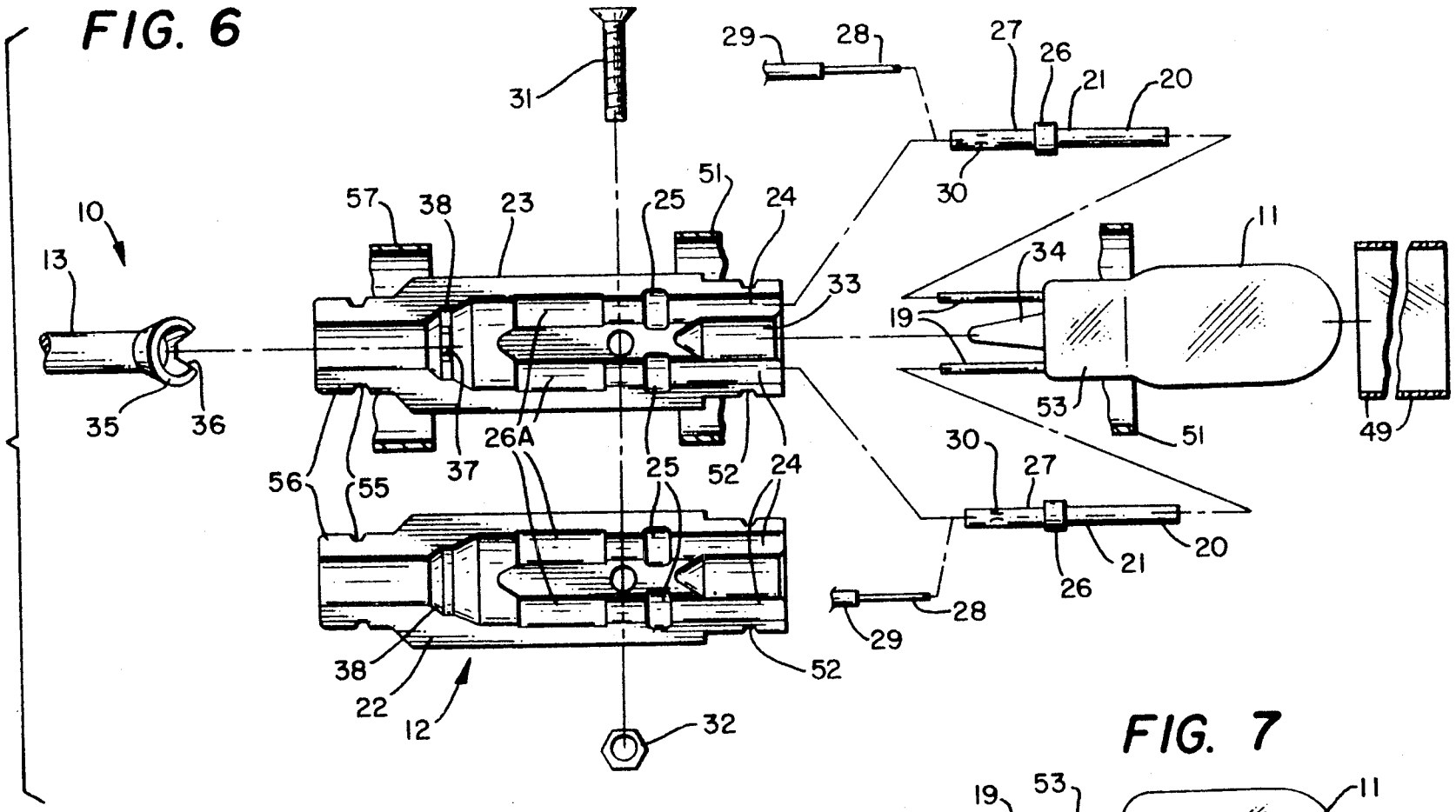
Figure 7:
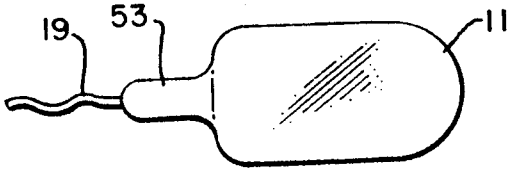

In the drawings:

FIG. 1 represents a side elevation of the limited access long stemmed small diameter probe light with the light bulb and socket cap lifted off and the power plug removed;

FIG. 2, a partially broken away and sectioned enlarged view of the probe light of FIG. 1, showing probe light and light socket detail with a translucent shrink tube in place and a light shielding opaque shrink tube in place on the base of the bulb, and handle interior detail with power plug;

FIG. 3, a partial lifted away perspective view of the probe light stem with handle stem mounting flange end detail;

FIG. 4, a transverse section view taken along line 4—4 of FIG. 1 showing lamp socket to probe light stem connection detail;

FIG. 5, a transverse section view taken along line 5—5 of FIG. 1 showing handle to probe light stem connection detail;

FIG. 6, an enlarged exploded view of the probe light and socket showing more assembly and parts detail; and FIG. 7, a side elevation view of the probe light showing wave bent prong leads.

Referring to the drawings:

The limited access area long stemmed small diameter probe light 10 of FIGS. 1, 2 and 6 is shown to have a small diameter light bulb 11 that for good lighting is, for example, a halogen light bulb that is a high intensity light bulb pulling relatively high amperage and thereby developing considerable heat. The light bulb 11 is plugged into a small cross-sectioned in transverse section rectangular socket 12 that has a rear connection to a long tubular small diameter brass rod 13, that is bendable for use convenience, and that helps conduct heat away from the lamp bulb socket 12. The other end of the tubular brass rod 13, that is the stem of the long stemmed probe light 10, is connected to a handle 14 that is approximately two and two thirds the diameter of the light bulb 11 and is equipped with a rear end plug in socket 15 for plug in connection of power plug 16 line 17 extended from a power source not shown. This eliminates the need for power switches that can otherwise be a problem at times. There is a removable protective plastic cap 18 that is placeable extending over the bulb 11 and light socket 12 when the probe light is not in use.

The small diameter light bulb 11 has two plug in leads 19 that are bent in a wave shape such as shown in FIG. 7 to insure good electrical contact through an extensive heat temperature range when they are plugged into internal socket openings in the socket ends 20 of two tubular socket pins 21. Socket pins 21 are mounted in spaced parallel relation insulated from each other in the rectangular socket 12, that is assembled from two matching halves 22 and 23 of electrically insulative material, having two forward openings 24, two annular grooves 25 holding annular shoulders 26 on socket pins 21, and two rearward openings 26A. The tubular socket pins 21, of current carrying and heat conductive material such as copper, each have forward lamp socket ends 20 and rearward of annular shoulders 26 power line receiving ends 27 into which the insulation stripped ends 28 of two power lines 29 are inverted and crimped 30 in place. The two matching halves 22 and 23 assembled together by screw (or bolt) 31 and nut 32 also present a relief opening 33 for the bottom seal tab extension 34 of bulb 11 when it is plugged in place in rectangular socket 12. The brass rod 13 is formed with, or has swedged thereon, at the forward end thereof a bell like flange 35 having a cut out 36, into which an internal extension 37 within the portion of a socket opening 38 in half 23 of socket 12 extends, preventing relative rotation between the rod 13 and socket 12, referring also to FIG. 4. Referring in addition to FIGS. 3 and 5 the other end of the brass rod 13 has washer 39 with a cut off flat 40 pressed thereon received non-rotatably inside handle 14 with internal projection 41 matching the flat 40 of washer 39 to hold it in a non-rotatable state and thereby non-rotatable with respect to rod 13. The power lines 29 are passed through the tubular opening 42 of rod 13 from within handle 14 where they are soldered to power leads 43 and 44 from two conductor socket prong 45 mounted in wall 46 of socket member 15 having a nose projection 47 bonded in place in opening 48 at the back end of handle 14. The small heavy duty socket with it's non-rotating interconnect with brass rod 13 prevents power lines 29 from twisting and short circuiting or pulling loose. At the other end of brass rod 13 the non-rotating interconnection with the handle also prevents rotation and pulling or short circuiting of power lines 29 within the handle 14. The two conductor socket prong 45 recessed in handle 14 helps prevent breakage and eliminates the need for a power switch that otherwise could be a major problem with this type probe light. It should be noted that use of two power line wires, one bare and one insulated permits use of larger heavier duty power line wires through tubular opening 42 in rod 13. By way of reiteration half hard, bendable brass or copper rod 13 is flared 35 at one end to also prevent pull out from socket 12. A flanged eyelet washer 39 with a flat 40 on one side is pressed and/or soldered on the handle 14 end of the bendable rod 13 where the flat 40 mating with interal projection 41 prevents rotation of rod 13 in handle 14.

A high temperature teflon translucent tubular sheath 49 is heat shrunk on lamp bulb 11 and the bulb shank 53 to not only give protection from high pressure shattering of the bulb 11 but also diffuse the light to a more uniform illuminating source. The heat shrunk teflon tubular sheath 49 leaves an opening 50 at the nose end of bulb 11 that would be covered if a teflon cup were heat shrunk thereon instead of tubular sheath 49. An opaque teflon tubular sheath 51 is heat shrunk overlapping heat shrunk tubular sheath 49 over the bulb shank 53 and extending back over the forward end, including groove 52, of socket 12 to provide some light shielding for the user of the probe light 10. An additional teflon tubular sheath 57 has a heat shrunk down section 54 on the rear end shank 56, of socket 12, including groove 55, and is shrunk down on the tubular brass rod 13 between socket 12 and handle 14. The tubular sheath 57 extends through shrunk down section 58 on handle nose 59 and can also extend up over handle nose shoulder 60. Shrink tubular sheath 57 shrunk over the bendable tubular rod 13 and over a small nose part of the handle 14 and also a small part of the socket 12 helps prevent relative longitudinal movement of the rod 13 in both the handle 14 and the socket 12.

Whereas this invention has been described with respect to a preferred embodiment thereof, it should be realized that various changes may be made without departure from the essential contributions to the art made by the teachings hereof.

I claim:

1. A limited access area long stemmed small diameter high intensity light probe comprising: a small diameter light bulb with external structure which does not extend beyond intimate contact with said small diameter light bulb and, a male socket with two bulb flat leads bent in a wave shape to insure good electrical contact when plugged into a female light bulb socket through an extensive heat temperature range; said male socket with two tubular socket tubes of current carrying and heat conductive material mounted in spaced parallel relation, from each other, in said male light bulb socket receiving the two bulb flat leads when said small diameter light bulb is plugged into said female light bulb socket; a handle; a long tubular rod that is a small diameter metal rod extended from said handle to said female light bulb socket and connected to both; two power lines with at least one power line an insulated power line passed through said long tubular rod; electric power connection means in said handle for said two power lines; and with said two power lines connected, individually, to said two tubular socket tubes; wherein a high temperature translucent teflon tubular sheath is heat shrunk on the small diameter light bulb to not only give protection from high pressure shattering of the small diameter light bulb but also to diffuse the light to a more uniform diffused light illuminating source.

2. A limited access area long stemmed small diameter high intensity light probe comprising: a small diameter light bulb with two bulb flat leads bent in a wave shape to insure good electrical contact when plugged into a female lamp bulb socket through an extensive heat temperature range; a male lamp bulb socket with two socket tubes of current carrying and heat conductive material mounted in spaced parallel insulated from each other relation in said female lamp bulb socket receiving the two bulb flat leads when said small diameter light bulb is plugged into said female lamp bulb socket; a handle; a long tubular rod that is a small diameter metal rod extended from said handle to said female lamp bulb socket and connected to both; two power lines with at least one power line an insulated power line passed through said tubular rod; electric power connection means in said handle for said two power lines; and with said two power lines connected, individually, to said two tubular socket tubes; wherein said two power lines have ends inserted into said two socket tubes.

3. The limited access area long stemmed small diameter high intensity light probe of claim 2, wherein said two tubular socket pins are each formed with annular shoulder means fitting annular groove means in said lamp bulb socket to restrain said tubular socket pins from longitudinal movement within said lamp bulb socket.

4. The limited access area long stemmed small diameter high intensity light probe of claim 3, wherein non-rotatable means is provided between said long tubular rod and said female lamp bulb socket.

5. The limited access area long stemmed small diameter high intensity light probe of claim 4, wherein said non-rotatable means is a projection and notch interconnect between said socket light bulb and a flanged end of said long tubular rod within said female lamp bulb socket.

6. The limited access area long stemmed small diameter high intensity light probe of claim 4, wherein non-rotatable means is provided between said long tubular rod and said handle.

7. The limited access area long stemmed small diameter high intensity light probe of claim 6, wherein said non-rotatable means is a washer fastened to an end of said long tubular rod and having a removed portion and a projection in the handle interior extended into the removed portion of said washer.

8. The limited access area long stemmed small diameter high intensity light probe of claim 7, wherein said electric power connection means in said handle for two power lines is an electric power plug receptacle in said handle.

9. The limited access area long stemmed small diameter high intensity light probe of claim 8, wherein a high temperature translucent teflon tubular sheath is heat shrunk on the light bulb to not only give protection from high pressure shattering of the light bulb but also to diffuse the light to a more uniform diffused light illuminating source.

10. The limited access area long stemmed small diameter high intensity light probe of claim 9, wherein said small diameter light bulb has a bulb shank mounting said two bulb flat leads; and an opaque plastic tubular sheath heat shrunk over said bulb shank and extended back over a portion of said female lamp bulb socket.

11. The limited access area long stemmed small diameter high intensity light probe of claim 10, wherein said opaque plastic tubular sheath overlaps said high temperature translucent teflon tubular sheath.

12. The limited access area long stemmed small diameter high intensity light probe of claim 10, wherein said opaque plastic tubular sheath extends far enough over said small diameter light bulb to act as an eye shield from the small diameter light bulb when a user is looking from a handle end.

13. The limited access area long stemmed small diameter high intensity light probe of claim 10, wherein nose section of said female lamp bulb socket has a groove with said opaque plastic tubular sheath heat shrunk extended down into said groove.

14. The limited access area of long stemmed small diameter high intensity light probe of claim 10, wherein a teflon tubular sheath is heat shrunk down on said long tubular rod, and on a rear end portion of said female light bulb socket and also on a front end portion of said handle; and with a groove in the rear end portion of said female light bulb socket with said teflon tubular sheath heat shrunk down into said groove.

15. The limited access area of long stemmed small diameter high intensity light probe of claim 14, wherein said long tubular rod is from half hard metals including half hard brass and half hard copper bendable for use convenience.

16. A limited access area long stemmed small diameter high intensity light probe comprising: a small diameter light bulb with external structure which does not extend beyond intimate contact with said small diameter light bulb and, a male socket with two bulb flat leads bent in a wave shape to insure good electrical contact when plugged into a female light bulb socket through an extensive heat temperature range; said male socket with two tubular socket tubes of current carrying and heat conductive material mounted in spaced parallel relation, from each other in said female light bulb socket receiving the two bulb flat leads when said small diameter light bulb is plugged into said female light bulb socket; a handle; a long tubular rod that is a small diameter metal rod extended from said handle to said light bulb socket and connected to both; two power lines with at least one power line an insulated power line passed through said long tubular rod; electric power connection means in said handle for said two power lines; and with said two power lines connected, individually to said two tubular socket tubes; wherein said small diameter light bulb has a bulb shank mounting said two bulb flat leads; and an opaque plastic tubular sheath heat shrunk over said bulb shank and extended back over a portion of said female light bulb socket.

17. The limited access area of long stemmed small diameter high intensity light probe of claim 16, wherein said opaque plastic sheath extends far enough over said small diameter light bulb to act as an eye shield from the small diameter light bulb when a user is looking from the handle toward said small diameter light bulb.

18. The limited access area of long stemmed small diameter high intensity light probe of claim 17, wherein a nose section of said female light bulb socket has a groove with said opaque plastic tubular sheath heat shrunk extended down into said groove.

19. The limited access area of long stemmed small diameter high intensity light probe of claim 16, wherein a teflon tubular sheath is heat shrunk down on said long tubular rod, and on a rear end portion of said female light bulb socket and also on a front end portion of said handle; and with a groove in the rear end portion of said female light bulb socket with said teflon tubular sheath heat shrunk down into said groove.

* * * * *